United States Patent [19]

Vaesken et al.

[11] 4,030,883

[45] June 21, 1977

[54] PROCESS FOR TREATING NATURAL POLYAMIDE FIBRES OF ASYMMETRIC STRUCTURE, SUCH AS WOOL, WITH LIQUID AMMONIA

[75] Inventors: Maryvonne J. Vaesken; Alain E. Bultez; Jean-Paul Dalle, all of Saint Quentin, France

[73] Assignee: Opi Cryochimie S.A., Grugies, France

[22] Filed: Feb. 4, 1975 (Under Rule 47)

[21] Appl. No.: 546,902

[30] Foreign Application Priority Data

Feb. 4, 1974 France ..... 74.03571

[52] U.S. Cl. ..... 8/115.5; 8/97; 8/128 R

[51] Int. Cl.[2] ..... D06M 1/18

[58] Field of Search ..... 8/115.5, 128 R, 127.5, 8/127.51, 127.6, 95, 97

[56] References Cited

UNITED STATES PATENTS

| | | | |
|---|---|---|---|
| 3,666,398 | 5/1972 | Tratnyek | 8/82 |
| 3,802,835 | 4/1974 | Prieto | 8/82 |
| 3,824,076 | 7/1974 | Ortheil | 8/82 |
| 3,905,763 | 9/1975 | Dalle | 8/128 R |

FOREIGN PATENTS OR APPLICATIONS 1,372,825 11/1974 United Kingdom

OTHER PUBLICATIONS

Chemical Abstracts, vol. 60, 69 and 81, 10951f, 20271s and 171037u respectively.

Fierz-David, H. E. et al., Fundamental Processes of Dye Chemistry, N. Y., 1949, p. 377.

*Primary Examiner*—Joseph L. Schofer
*Assistant Examiner*—W. Schulz
*Attorney, Agent, or Firm*—Lewis H. Eslinger

[57] ABSTRACT

This invention relates to a process for treating natural polyamidic fibres of asymmetric structure, particularly wool, with liquid ammonia, in which a nucleophilic substance is added to said liquid ammonia. The treatment time is thus reduced and the dye affinity is improved.

An acetate, such as ammonium acetate is preferably used and excellent results are obtained on wool.

3 Claims, No Drawings

PROCESS FOR TREATING NATURAL POLYAMIDE FIBRES OF ASYMMETRIC STRUCTURE, SUCH AS WOOL, WITH LIQUID AMMONIA

The present invention relates to a process for treating natural polyamidic fibres of asymmetric structure, and more especially wool, with liquid ammonia.

French Patent No. 72 08875 of 14th Mar. 1972 describes a process for treating fibres of this type which consists in reacting liquid ammonia on said fibres, in order to improve their textile properties, and in particular their bulky appearance and elasticity.

It has been ascertained that to obtain a long-lasting improvement of the properties obtained, the action of the liquid ammonia, generally effected at −33° C (boiling point of ammonia at atmospheric pressure) must be relatively long. According to the way in which the fibres, flock, threads, woven and knitted fabrics or the like are treated, it may even be necessary for the action to last for more than 1 hour. This is obviously a considerable drawback, since its continuous application is rendered difficult.

The aim of the present invention is to reduce the necessary time of contact between the material to be treated and the liquid ammonia, whilst obtaining a treated product having identical or equivalent properties. The Applicants have ascertained that the addition of certain chemical substances to the liquid ammonia enabled this aim to be achieved.

It is therefore an object of the present invention to provide a process of treating natural polyamidic fibres and more especially wool, by liquid ammonia, in which the fibres are treated by ammonia containing effective amounts of nucleophilic substances soluble in this ammonia. Nucleophilic substances are understood to mean any substance having an affinity for positive centres. From these substances, choice is preferably directed to anions such as acetates or chlorides. They may be added to the liquid ammonia in the form of salts which easily dissolve in the ammonia, but also in the form of acids.

The treatment of natural polyamidic fibres by liquid ammonia as well as the results obtained were described in French Pat. No. 72 08875 of 14th Mar. 1972 and will not be repeated here. The natural polyamidic fibres are also called polypeptidinic fibres. It has been ascertained that the treatment according to the present invention was particularly advantageous in the case of polypeptidic fibres of asymmetric structure, of which the best example is obviously wool. This is why the following tests, which are intended to illustrate the invention and render understanding thereof easier, have been carried out in this way.

The action of the liquid ammonia in which a nucleophilic substance had been previously dissolved may be effected by any conventional process such as immersion in a bath maintained at −33° C. It is ascertained that products which have the same improved properties are obtained either by treating in known manner for longer than 30 minutes and in a bath of pure ammonia, or by treating according to the invention for about ten minutes and in a bath of ammonia containing a nucleophilic substance. The desired qualities will be obtained by varying the treatment times, the type of nucleophilic substance used and the quantity thereof. Of the nucleophilic substances that may be used, the most efficient were noted to be acetates, and chlorides. Due to the role of the ammonia, these anions may be introduced into the ammonia in the form of salts, such as ammonium acetate or in the form of acids, such as acetic acid. The concentration of nucleophilic substance may be relatively low. It is sufficient to add about 5% by weight in the case of ammonia acetate to obtain satisfactory results.

The efficiency of nucleophilic substances such as aluminum, potassium or sodium chlorides has also been noted. Sodium acetate has also been tested. Although its efficiency is greater than that of the chlorides, it is apparently lower than that of the ammonium acetate. It is certain that a salt which dissolves easily in the ammonia may be used in better conditions.

After the treatment with ammonia, said latter is eliminated from the matter by any suitable means: washing, drying . . . . . If the nucleophilic substance is inconvenient for the subsequent treatments, it is also eliminated, e.g. by washing.

Such a process enables the treatment time to be very substantially reduced, but it is ascertained in addition that this does not cause the material to retract more than with a mode of treatment that is already known. An improved dye affinity is also noted, which enables an improved result to be obtained under the same dyeing conditions.

In a natural polyamidic fibre such as wool, subjected to a basic medium, the cystine is known to be converted into lanthionine. It is probable that the nucleophilic substance added to the liquid ammonia serves to some extent as a catalyst in this conversion and enables the supplementary contraction of the fibre to be fixed.

The following tests, which clearly bring out the advantages of the invention, were carried out on a wool fabric weighing about 350g/m².

EXAMPLE 1

A sample is maintained in a bath of pure liquid ammonia at −33° C at atmospheric pressure for 45 minutes. The ammonia is eliminated simple by drying in the open air.

The sample is then noted to present a bulky appearance and a considerable elasticity, in accordance with the results described in French Pat. No. 72 08875.

This sample is then dyed by a conventional dyeing process. The dye used in Bleu Foulon Lumiere BL, which has the following formula:

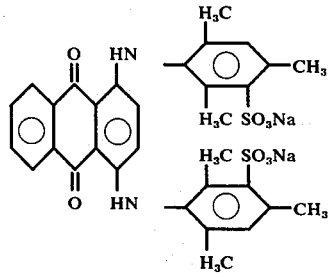

The dye bath, containing 1% by weight of dye and 10% of sodium sulphate, and acidified up to pH 5.5 by acetic acid, is taken to 40° C. After introduction of the sample, the temperature is taken in 30 minutes to 90°–95° C. The matter is kept at this temperature for one hour to obtain a good extraction. After washing, the sample is noted to contain about 2 to 3% by weight of dye.

An identical sample not treated by the liquid ammonia and dyed under the same conditions contains only about 1% of dye.

EXAMPLE 2

A bath of liquid ammonia is prepared which contains 5% of ammonium acetate. A sample maintained in this bath for 5 to 10 minutes is noted to present substantially the same characteristics as the sample of Example 1. If the duration of the treatment is increased, the sample then shrinks considerably and is rough to the touch. Although a quantity of acetate may be added to the bath which is much greater than the quantity used, it has been ascertained that this did not enable the treatment time to be further reduced nor better characteristics to be obtained.

The dyeing, under the same conditions as Example 1, of a sample treated in this way for 5 to 10 minutes, is noted to present a dye content varying between 3 and 4% by weight of the material.

EXAMPLE 3

About 5% of ammonium chloride is added to the ammonia bath. The optimum treatment time is noted to be 20 minutes. The dyeing, by the same process, leaves about 3% of dye on the material.

EXAMPLE 4

With the addition to the ammonia bath, of about 5% of ammonium nitrate or ammonium sulphate, the optimum treatment time is noted to be 30 minutes. The dye yields are then from 2 to 3%.

What we claim is:

1. In a process for treating natural polyamidic fibers of asymmetric structure wherein the fibers are treated with liquid ammonia in order to improve their properties, the improvement consisting of contacting said fibers with liquid ammonia containing an effective amount of an acid or salt containing an acetate or chloride anion for from 5 to 30 minutes.

2. A process as claimed in claim 1, wherein an ammonium salt is used.

3. A process as claimed in claim 1, wherein about 5% of said acid or salt is employed.

* * * * *